United States Patent [19]

Gueguen

[11] 4,145,696

[45] Mar. 20, 1979

[54] BROAD BAND, OMNIDIRECTIONAL UHF, VHF ANTENNA

[75] Inventor: Michel Gueguen, Lannion, France

[73] Assignee: Societe Lannionnaise d'Electronique Sle-Citerel, Lannion, France

[21] Appl. No.: 754,241

[22] Filed: Dec. 27, 1976

[30] Foreign Application Priority Data

Jan. 12, 1976 [FR] France ..... 76 00559

[51] Int. Cl.[2] ..... H01Q 11/10; H01Q 21/20; H01Q 1/12

[52] U.S. Cl. ..... 343/792.5; 343/800; 343/890

[58] Field of Search ..... 343/792.5, 799, 800, 343/890, 891

[56] References Cited

U.S. PATENT DOCUMENTS

| | | | |
|---|---|---|---|
| 3,254,343 | 5/1966 | Laub et al. | 343/800 |
| 3,329,959 | 7/1967 | Laub et al. | 343/800 |
| 3,618,103 | 11/1971 | Ringland | 343/792.5 |
| 3,943,522 | 3/1976 | Ben-Dov | 343/890 |
| 4,005,432 | 1/1977 | Beccario | 343/792.5 |

OTHER PUBLICATIONS

Isbell, *Log Periodic Dipole Arrays,* in IRE Transactions on Antennas and Propagation, vol. AP-8, No. 3, pp. 263-265, 1960.

*Primary Examiner*—Alfred E. Smith
*Assistant Examiner*—Harry Barlow
*Attorney, Agent, or Firm*—Roland Plottel

[57] ABSTRACT

An omnidirectional, broad-band antenna for installation on a vertical mast. The antenna is formed of one or more superposed arrays of elementary antennas in the form of log-periodic alignments of vertical dipoles. Particularly for use in ground stations for ground-air communications.

4 Claims, 4 Drawing Figures

BROAD BAND, OMNIDIRECTIONAL UHF, VHF ANTENNA

The present invention relates to omnidirectional wide-band antennas having a small aperture in their vertical radiation patterns.

The recent dramatic increase in air traffic has led to a corresponding increase in the number of VHF and UHF bands used for ground-air links. As a result of this increase, and to enable different bands of the radio spectrum to be used, ground stations have increasingly been equipped with masts which carry a plurality of narrow-band omnidirectional antennas, each one covering a part of the frequency band used. The concentration of masts and antennas close to the ground stations has been found to cause masking effects and intermodulation between the various antennas.

To avoid these drawbacks, it has been suggested that omnidirectional, wide-band antennas staggered along a single, tall supporting mast be employed. Such an arrangement requires omnidirectional, wide-band antennas which can be placed on a pylon and which have a small aperture in their vertical radiation pattern in order to achieve satisfactory decoupling by spacing of the antennas along the mast.

In the known antenna systems of this sort, the supporting mast is a tall, guyed pylon having a metallic lattice structure. In general, each omnidirectional wide-band antenna comprises one or more superposed circular arrays of four elementary antennas disposed at 90° to each other around the mast, each antenna being in the form of a vertical dipole associated with a plane reflector.

The height of the mast is a function of the number of antennas which it supports and of their spacing. The cross-section of the mast depends on its height, its weight and the number of elementary antennas it supports.

Preferred embodiments of the present invention reduce the weight of the antennas as well as their size and above all their spacing, without reducing their performance, thereby reducing the cross-section and height requirements of the supporting pylon and consequently the cost of the antenna system.

The present invention provides an omnidirectional, wide-band VHF/UHF radio antenna suitable for installation at an intermediate point on a supporting mast, the antenna comprising at least one circular array of not more than three elementary antennas, each elementary antenna comprising a log-periodic alignment of vertical dipoles.

An embodiment of the invention is described, by way of example, with reference to the accompanying drawings, which are perspective views of a metallic mast on which a UHF antenna embodying the invention is disposed.

More specifically,

Figure 1:
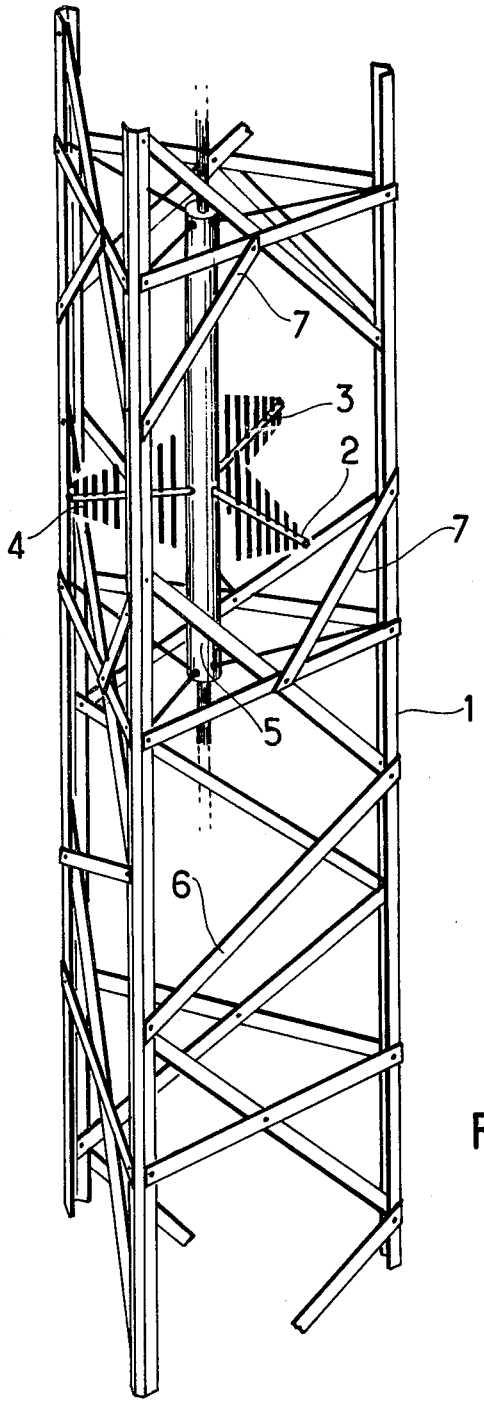
FIG. 1 is a perspective view of a metallic mast on which is disposed a VHF antenna comprising a circular array of three log-periodic vertical dipoles.

Log-periodic VHF and UHF radio antennas are characterized by radiating elements, each derived from the other by multiplying the dimension of the previous element by a factor t. By keeping this factor near to unity, the radiation characteristics of such an antenna can be made to be nearly independent of frequency over a band limited by a lower frequency which is determined by the dimensions of the largest radiating element and by an upper frequency which is determined by the dimensions of the smallest radiating element.

Antennas comprising a log-periodic alignment of dipoles being to the family of antennas mentioned above. Such a log-periodic antenna comprises an alignment of dipoles in which the spacing between the dipoles and their dimensions follow a geometric progression of factor t. The radiation pattern of such an antenna is unidirectional and is maximum in the direction defined by the mid points of the dipoles and going towards the shortest dipole. The structure and the calculations needed to fabricate such an antenna are known. The dimensions of the end dipoles are a function of the edge frequencies of the band to be transmitted. The number of intermediate dipoles, their dimensions and spacing are derived from the angle a between the lines joining the ends of the dipoles, and the geometric progression factor t which are obtained from charts which give the gain or aperture of the radiation pattern in the H plane as a function of the parameters a and t.

Antennas of the type discussed above are used for point-to-point radio links for which it is essential to have high gain. They typically comprise a large number of vertical dipoles aligned with a small angle a and with a coefficient t near to unity. Their back radiation is greatly attenuated and the aperture of their radiation pattern is smaller in the E plane (vertical) than in the H plane (horizontal).

This kind of antenna was heretofore considered unsuitable for replacing the vertical dipoles and plane reflectors used in conventional omnidirectional antennas, particularly because of their weight, size and the small aperture of the radiation patterns in the H plane (horizontal). In fact, the need to reduce this aperture by reducing antenna gain argues against making such a replacement, since it is well known that a reduction in gain brings with it two troublesome phenomena, namely: an increase in the aperture in the E plane (vertical) and an increase in side lobes.

Notwithstanding the above, in the instant invention an increase in the aperture of the horizontal radiation pattern has been obtained by increasing the value of the angle a which brings about a reduction in the number of dipoles and consequently reduces the weight and size of the antenna. This is accompanied by an increase in the aperture of the vertical radiation pattern but to a lesser degree so that this aperture remains less than that which would be obtained using a radiating element formed of a vertical dipole associated with a plane reflector. In this way, the directivity of the antenna is reduced while at the same time keeping its performance superior to that of the vertical dipole with plane reflector. Thus, for a UHF pass-band of 225 to 400 MHz, using a log-periodic antenna with eight vertical dipoles calculated to have a 3 dB aperture of 120° in the horizontal plane, the following characteristic results were obtained:

(1) a weight which is lower than for a vertical dipole with plane reflector;

(2) an average SWR in the order of 1.2 over the frequency band 225–400 MHz;

(3) a pronounced radiation null at 90° in the vertical plane (−25 to −30 dB);

(4) a directional pattern with the ratio of back to front radiation being −20 dB whereas the corresponding Figure is only −10 dB for a vertical dipole with plane reflector;

(5) an aperture in the vertical plane which is smaller than for a vertical dipole with plane reflector (+35° at 3 dB instead of ± 50°).

The log-periodic antenna according to the invention is fed by a line going from the smallest dipole to the largest and may be grounded at its end.

Its structure is entirely at ground potential which ensures better protection against lightning and less interference during reception.

FIG. 1 shows an omnidirectional wide-band antenna according to the invention installed partially up a pylon 1. This antenna is comprised of an array of three identical elementary antennas 2, 3 and 4 disposed at 120° to each other and fed in-phase from a three-way divider mounted in a central cylinder 5 and incorporating a wide-band isolating transformer.

The pylon 1 has a metallic lattice structure and a constant triangular section of about 1.2m per side. In a conventional manner, it comprises three angled vertical edge members held together by braces, some of which are diagonally disposed as at 6. It is advantageously guyed. The number of layers of guy ropes is a function of the height of the pylon. Typically, each layer comprises three metal guy ropes disposed at 120° at the edge members.

In one possible configuration, each elementary antenna 2, 3 or 4 is in the form of a log-periodic alignment of seven or eight vertical dipoles. For a UHF pass-band of 225 to 400 MHz each elementary antenna is about 0.70 m long and the span of the largest dipole is of the order of 0.8 m. For a VHF pass-band of 110 to 150 MHz each elementary antenna is about 1.2 m long with a maximum span of the order of 1.45 m. The elementary antennas 2, 3 and 4 are disposed partially inside the pylon 1 and perpendicularly oriented to its faces. To do this it is necessary to modify the structure of the pylon 1 at the level of the elementary antennas 2, 3 and 4 and to replace the diagonal braces 6 by four short diagonals 7 leaving a clear path for the antennas. This disposition does not degrade the overall radiation pattern of the elementary antennas 2, 3 and 4 and has many mechanical advantages, in particular a lowering of the wind resistance of the antennas and an easier assembly of the three elementary antennas and their dividers. This is made possible by the directivity of the radiation patterns of the elementary antennas 2, 3 and 4 and by installing them in the middle of the faces of the pylon 1 between the guy ropes.

The overall antenna created by the three elementary antennas 2, 3 and 4 has an omnidirectional radiation pattern in the horizontal plane with an average isotropic gain 2.5 dB. Further, the decoupling obtained between such an antenna and a similar antenna mounted on the same pylon is excellent since a vertical separation of 5 meters is sufficient to obtain a decoupling value better than, or equal to, 50 dB (including VHF). With respect to the prior art, these decoupling characteristics allow a shorter pylon to be used and hence a pylon having a smaller cross-section, for an equivalent number of omnidirectional antennas.

Figure 3:
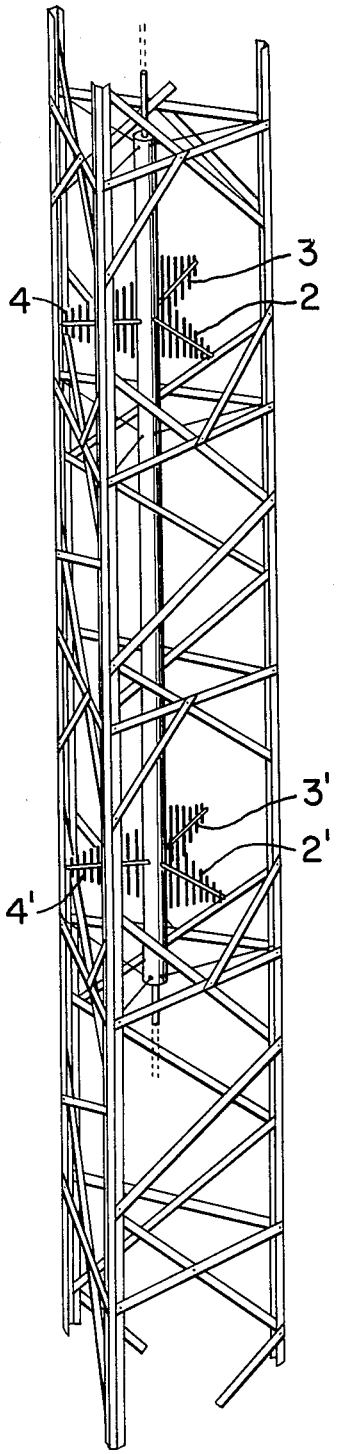
FIG. 3 is a perspective view of an antenna comprising two circular arrays of three log-periodic vertical dipoles.
Figure 2:
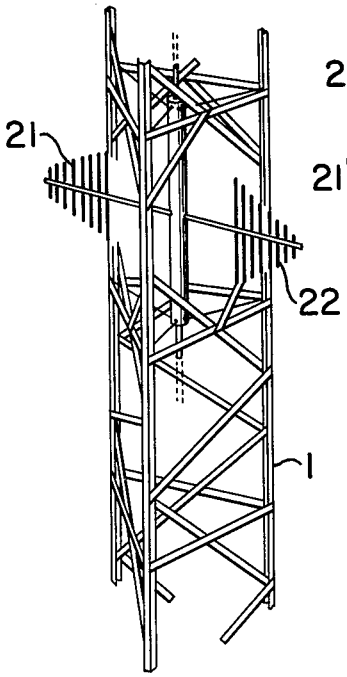
FIG. 2 is a perspective view of an antenna comprising a circular array of two log-periodic vertical dipoles.
Figure 4:
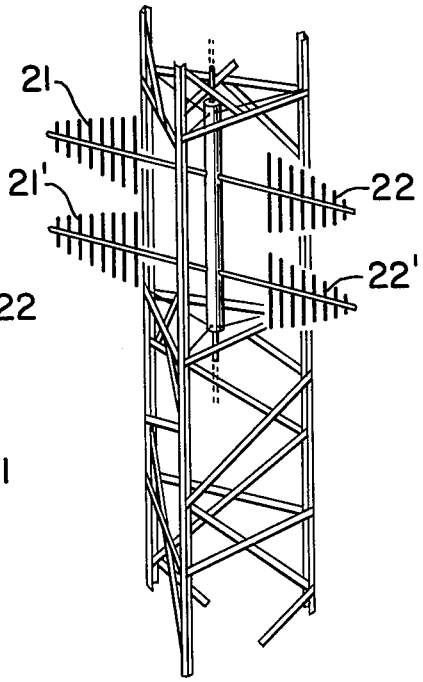
FIG. 4 is a perspective view of an antenna comprising two circular arrays of two log-periodic vertical dipoles.

Many embodiments of the omnidirectional antenna which has just been described are possible. In particular, by modifying the number of elementary antennas in an array or by using several superposed arrays, interesting results may be achieved. A particularly interesting wide-band omnidirectional antenna from the cost and size point of view is shown in FIG. 2. This antenna is made of two identical elementary antennas 21 and 22, fed in phase, oriented at 180° from each other and each in the form of a log-periodic alignment of vertical dipoles calculated to produce a 140° aperture to 3 dB in the horizontal plane. Wide-band omnidirectional antennas with better vertical plane directivity can be fabricated as shown in FIGS. 3 and 4 by arranging two superposed arrays of elementary antennas each in the form of log-periodic alignments of vertical dipoles, for example two superposed arrays of two or three elementary antennas according to FIGS. 1 or 2.

More specifically, the arrangement shown in FIG. 3 comprises a first array of three identical antennas 2, 3 and 4 disposed at 120° to each other and fed in-phase from a first three-way divider mounted in central cylinder 5, exactly as described with reference to FIG. 1. Unlike the arrangement shown in FIG. 1, however, the arrangement shown in FIG. 3 includes a second array of three identical antennas 2', 3' and 4', identical to the first array, and also disposed at 120° to each other and fed in-phase from a second three-way divider mounted in central cylinder 5.

In like fashion, the arrangement shown in FIG. 4 comprises a first array of two identical antennas 21 and 22, fed in-phase, and oriented at 180° from each other, as described with reference to FIG. 2. Unlike FIG. 2, however, the arrangement shown in FIG. 4 includes a second array, identical to the first, and includes a pair of identical antennas 21' and 22', fed in-phase, and oriented at 180° from each other.

What we claim is:

1. An omnidirectional, wide-band antenna for installation at some intermediate point on a supporting mast, said antenna comprising a single array of three identical log-periodic alignments of vertical dipoles, fed in-phase and disposed at 120° to each other.

2. An omnidirectional, wide-band antenna for installation at some intermediate point on a supporting mast, said antenna comprising at least two superposed arrays each of which comprises three identical log-periodic alignments of vertical dipoles, fed in-phase and disposed at 120° to each other.

3. An omnidirectional, wide-band antenna for installation at some intermediate point on a supporting mast, said antenna comprising a single array of two identical log-periodic alignments of vertical dipoles, fed in-phase and disposed at 180° to each other.

4. An omnidirectional, wide-band antenna for installation at some intermediate point on a supporting mast, said antenna comprising at least two superposed arrays each of which comprises two identical log-periodic alignments of vertical dipoles, fed in-phase, and disposed at 180° to each other.

* * * * *